US011146002B2

(12) United States Patent
Ellis et al.

(10) Patent No.: US 11,146,002 B2
(45) Date of Patent: Oct. 12, 2021

(54) DIRECT-ATTACH CONNECTOR

(71) Applicant: Samtec, Inc., New Albany, IN (US)

(72) Inventors: Travis S. Ellis, New Albany, IN (US); Norman S. McMorrow, New Albany, IN (US); Keith R. Guetig, New Albany, IN (US)

(73) Assignee: SAMTEC, INC., New Albany, IN (US)

( * ) Notice: Subject to any disclaimer, the term of this patent is extended or adjusted under 35 U.S.C. 154(b) by 173 days.

(21) Appl. No.: 15/733,007

(22) PCT Filed: Jul. 21, 2017

(86) PCT No.: PCT/US2017/043204

§ 371 (c)(1),
(2) Date: Feb. 8, 2019

(87) PCT Pub. No.: WO2018/034789

PCT Pub. Date: Feb. 22, 2018

(65) Prior Publication Data

US 2019/0181570 A1 Jun. 13, 2019

Related U.S. Application Data

(60) Provisional application No. 62/376,765, filed on Aug. 18, 2016.

(51) Int. Cl.

| | |
|---|---|
| ***B23P 19/00*** | (2006.01) |
| ***H01R 43/00*** | (2006.01) |
| ***H01R 12/59*** | (2011.01) |
| ***H01R 12/62*** | (2011.01) |
| ***H01R 13/6591*** | (2011.01) |
| ***H01R 43/20*** | (2006.01) |
| *H01R 43/16* | (2006.01) |

(52) U.S. Cl.
CPC ..... *H01R 12/592* (2013.01); *H01R 12/62* (2013.01); *H01R 13/65914* (2020.08);
(Continued)

(58) Field of Classification Search
CPC .... H01B 11/002; H01B 11/04; H01B 7/0807; H01R 13/6592; H01R 13/6471;
(Continued)

(56) References Cited

U.S. PATENT DOCUMENTS

| | | | |
|---|---|---|---|
| 7,168,963 B2 | 1/2007 | Minich et al. | |
| 9,142,921 B2 * | 9/2015 | Wanha | H01R 13/6473 |

(Continued)

FOREIGN PATENT DOCUMENTS

| | | |
|---|---|---|
| CN | 2569292 Y | 8/2003 |
| CN | 204243262 U | 4/2015 |
| JP | 2013-084472 A | 5/2013 |

OTHER PUBLICATIONS

Official Communication issued in Chinese Patent Application No. 201780050067.8, dated Nov. 18, 2019.

(Continued)

*Primary Examiner* — Thiem D Phan
(74) *Attorney, Agent, or Firm* — Keating & Bennett, LLP

(57) ABSTRACT

A cable assembly includes a contact ribbon made of a single stamping and including pairs of first and second signal contacts and includes a cable including pairs of first and second center conductors connected to corresponding pairs of first and second signal contacts. The contact ribbon includes a ground plane, a first row of ground contacts extending from the ground plane in a row along a first side of the ground plane such that a first line extending through the first row of ground contacts does not intersect with any signal contacts, and a second row of ground contacts extending from the ground plane in a row along a second side of the ground plane such that a second line extending through the second row of ground contacts does not intersect with any signal contacts.

20 Claims, 14 Drawing Sheets

(52) U.S. Cl.
CPC ..... *H01R 43/205* (2013.01); *H01R 43/16* (2013.01); *Y10T 29/49174* (2015.01); *Y10T 29/53209* (2015.01)

(58) Field of Classification Search
CPC ..... H01R 13/6461; H01R 13/6585; H01R 13/65914; H01R 13/658; H01R 9/0512; Y10S 439/941; Y10T 29/49174; Y10T 29/49117; Y10T 29/49224; Y10T 29/53209
USPC ..... 29/47, 857, 729, 749, 842, 874, 747
See application file for complete search history.

(56) References Cited

U.S. PATENT DOCUMENTS

2005/0054226 A1 3/2005 Akama et al.
2007/0082555 A1 4/2007 Tanaka
2009/0215309 A1 8/2009 Mongold et al.
2012/0214351 A1 8/2012 Shiratori et al.
2014/0041937 A1 2/2014 Lloyd et al.
2015/0147906 A1 5/2015 Guetig et al.
2016/0118750 A1 4/2016 Guo et al.

OTHER PUBLICATIONS

Guetig et al., "Direct-Attach Connector", U.S. Appl. No. 14/551,590, filed Nov. 24, 2014.
Guetig et al., "Direct-Attach Connector", U.S. Appl. No. 15/610,881, filed Jun. 1, 2017.
Guetig et al., "Direct-Attach Connector", U.S. Appl. No. 15/809,169, filed Nov. 10, 2017.
Official Communication issued in International Patent Application No. PCT/US2017/043204, dated Nov. 2, 2017.

* cited by examiner

DIRECT-ATTACH CONNECTOR

CROSS-REFERENCE TO RELATED APPLICATIONS

This application claims the benefit of U.S. Provisional Application No. 62/376,765 filed Aug. 18, 2016, which is hereby incorporated by reference in its entirety.

BACKGROUND OF THE INVENTION

1. Field of the Invention

The present invention relates to connectors for high-speed signal transmission. More specifically, the present invention relates to connectors in which wires are directly connected to contacts of the connectors.

2. Description of the Related Art

High-speed cable routing has been used to transmit signals between substrates, such as printed circuit boards (PCBs), of electronic devices. Conventional high-speed cable routing often requires routing in very tight and/or low-profile spaces. However, as data rates increase (i.e., as the frequency of the high-speed signal increases), the cost of high-performance high-speed transmission systems increases as well. High-speed signals transmitted between substrates generally follow a path of:

1) a trace on a transmitting substrate;
2) a first connector mounted to the transmitting substrate;
3) a substrate of a second connector that is inserted into the first connector;
4) a high-speed cable connected to the second connector substrate at a transmitting end of the high-speed cable;
5) a substrate of a third connector connected to the high-speed cable at a receiving end of the high-speed cable;
6) a fourth connector, mounted to a receiving substrate, that receives the third connector substrate; and
7) a trace on the receiving substrate.

Conventional high-speed cable assemblies typically include two connectors (i.e., the second and third connectors listed above) that are connected by high-speed cables. Accordingly, conventional high-speed cable routing also requires two additional connectors (i.e., the first and fourth connectors listed above) to connect the high-speed cables to transmitting and receiving substrates.

The signal quality is affected every time the transmitted signal transfers from each of the listed items above. That is, the signal quality is degraded when the signal is transmitted between 1) the trace on the transmitting substrate and 2) the first connector mounted to the transmitting substrate, between 2) the first connector mounted to the transmitting substrate and 3) the second connector substrate that is inserted into the first connector, etc. The signal quality can even be affected within each of the items above. For example, a signal transmitted through the trace on the transmitting or receiving substrate can suffer significant insertion loss.

High-speed cable assemblies are relatively expensive, due in part to the cost high-speed cable and the two connectors that include substrates (i.e., the second and third connectors listed above). Each connector of the high-speed cable assembly also requires processing time. Thus, the full cost of a high-speed cable assembly cable includes the cable, the high-speed-cable-assembly connectors on each end of the cable, the processing time required for each of these connectors, and the area required on a substrate for each connector.

To reduce the overall size of the high-speed cable assembly, smaller connectors and cables have been attempted. However, using smaller connectors and cables can both increase the cost and reduce the performance of high-speed cable assemblies. Eliminating the high-speed cable assembly has been attempted by transmitting the signal only on substrates. However, signals transmitted on a substrate generally have higher insertion losses compared to many cables, including, for example, micro coaxial (coax) and twinaxial (twinax) cables. Thus, eliminating the high-speed cable assembly can result in reduced signal integrity and degraded performance.

Exotic materials and RF/Microwave connectors have been used to improve the performance of high-speed cable assemblies. However, such materials and connectors increase both the cost and the size of a high-speed cable assembly. Low-cost conductors, dielectrics, and connectors have been used to reduce the overall cost of systems that rely on high-speed cable routing. However, low-cost conductors, dielectrics, and connectors decrease the performance of high-speed cable assemblies and can also increase their size.

SUMMARY OF THE INVENTION

To overcome the problems described above, preferred embodiments of the present invention provide a high-speed cable assembly that is relatively small in size, cheap, and has high performance.

Preferred embodiments of the present invention provide a high-speed cable assembly with a low-profile connection to a substrate. Because the high-speed cable assembly connects perpendicularly or substantially perpendicularly to the substrate, zero keep-out space on the substrate is needed for slide insertion. Because there is no mating connector required on the substrate, the total amount of required system space, including on the substrate, is significantly reduced. The high-speed cable assembly also uses fewer connectors, resulting in fewer transitions in the signal transmission path. Fewer transitions simplifies the signal transmission path, improves system performance, and reduces costs.

According to a preferred embodiment of the present invention, a cable assembly includes a contact ribbon made of a single stamping including a plurality of pairs of first and second signal contacts; a ground plane; a first row of ground contacts extending from the ground plane in a row along a first side of the ground plane such that a first line extending through the first row of ground contacts does not intersect with any signal contacts of the plurality of pairs of first and second signal contacts; and a second row of ground contacts extending from the ground plane in a row along a second side of the ground plane such that a second line extending through the first row of ground contacts does not intersect with any signal contacts of the plurality of pairs of first and second signal contacts; and includes a cable including a plurality of pairs of first and second center conductors, each pair of the plurality of pairs of first and second center conductors is connected to a corresponding pair of the plurality of pairs of first and second signal contacts; a plurality of insulators each surrounding a corresponding pair of the plurality of pairs of first and second center conductors; and a shield that surrounds the plurality of insulators and that is connected to the ground plane.

The plurality of pairs of first and second signal contacts are preferably arranged in a single row. A first distance between the first row of ground contacts and the second row of ground contacts is preferably greater than a second distance between the single row of the plurality of pairs of first and second signal contacts and either of the first row of ground contacts or the second row of ground contacts. The first row of ground contacts and the second row of ground contacts are preferably located on the same side of the plurality of pairs of first and second signal contacts. Preferably, the contact ribbon is included in a housing, and a support member connecting the plurality of pairs of first and second signal contacts is removed from the contact ribbon after the contact ribbon is included in the housing.

The cable is preferably a twinaxial cable. The plurality of pairs of first and second signal contacts are preferably press-fit contacts or solderable contacts.

According to a preferred embodiment of the present invention, a method of manufacturing a cable assembly includes providing a contact ribbon including a plurality of pairs of first and second signal contacts; a ground plane; a first row of ground contacts extending from the ground plane in a row along a first side of the ground plane such that a first line extending through the first row of ground contacts does not intersect with any signal contacts of the plurality of pairs of first and second signal contacts; and a second row of ground contacts extending from the ground plane in a row along a second side of the ground plane such that a second line extending through the first row of ground contacts does not intersect with any signal contacts of the plurality of pairs of first and second signal contacts, providing a cable with a plurality of pairs of first and second center conductors, a plurality of insulators each surrounding a corresponding pair of the plurality of pairs of first and second center conductors, and a shield that surrounds the plurality of insulators, connecting each pair of the plurality of pairs of first and second signal contacts to a corresponding pair of the plurality of pairs of first and second center conductors at a first end of the cable, and connecting the shield to the ground plane at the first end of the cable.

Each pair of the plurality of pairs of first and second signal contacts is preferably connected to the corresponding pair of the plurality of pairs of first and second center conductors by crimping or soldering. The shield is preferably connected to the ground plane by soldering.

The method of manufacturing a cable assembly further preferably includes forming a housing for the contact ribbon before a support member connecting the plurality of pairs of first and second signal contacts is removed. Preferably, the housing includes at least one hole, and the support member is removed by punching or cutting the support member through the at least one hole of the housing.

The method of manufacturing a cable assembly further preferably includes attaching the cable assembly to a substrate before a support member connecting the plurality of pairs of first and second signal contacts is removed. Each signal contact of the plurality of pairs of first and second signal contacts is preferably connected to a corresponding hole in the substrate by soldering.

The plurality of pairs of first and second signal contacts are preferably press-fit contacts or solderable contacts. The plurality of pairs of first and second signal contacts are preferably arranged in a single row. A first distance between the first row of ground contacts and the second row of ground contacts is preferably greater than a second distance between the single row of the plurality of pairs of first and second signal contacts and either of the first row of ground contacts or the second row of ground contacts.

The first row of ground contacts and the second row of ground contacts are preferably located on a same side of the plurality of pairs of first and second signal contacts.

The above and other features, elements, steps, configurations, characteristics and advantages of the present invention will become more apparent from the following detailed description of preferred embodiments of the present invention with reference to the attached drawings.

DETAILED DESCRIPTION OF PREFERRED EMBODIMENTS

Preferred embodiments of the present invention will now be described in detail with reference to FIGS. 1 to 19. Note that the following description is in all aspects illustrative and not restrictive and should not be construed to restrict the applications or uses of the present invention in any manner.

Figure 1:
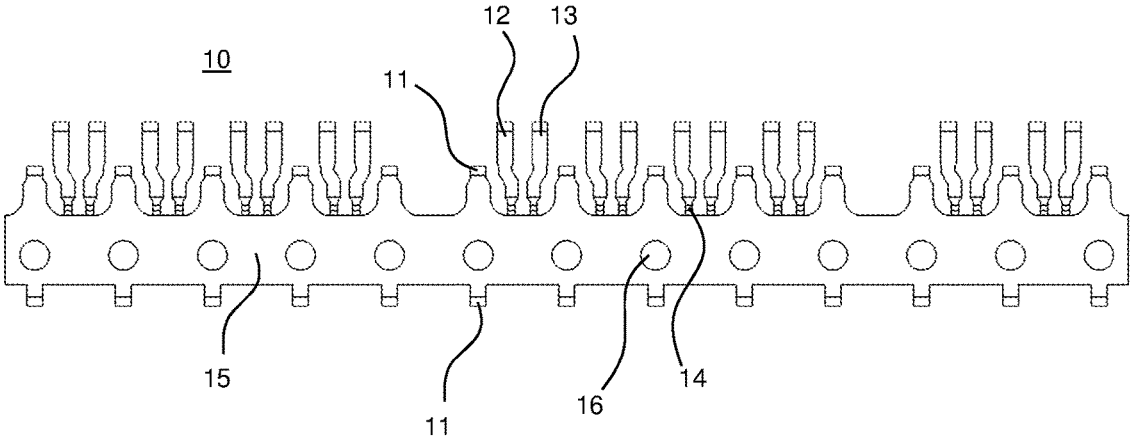
FIGS. 1 and 2 are views of a contact ribbon according to a preferred embodiment of the present invention.
Figure 2:
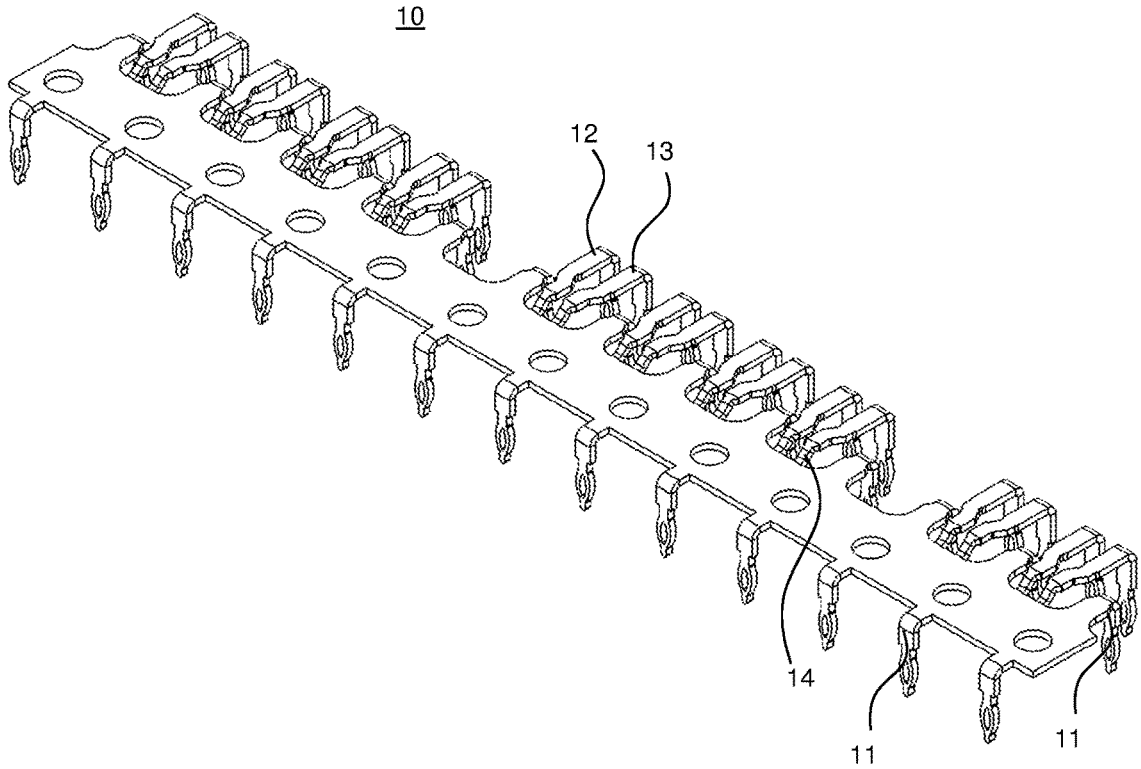
Figure 3:
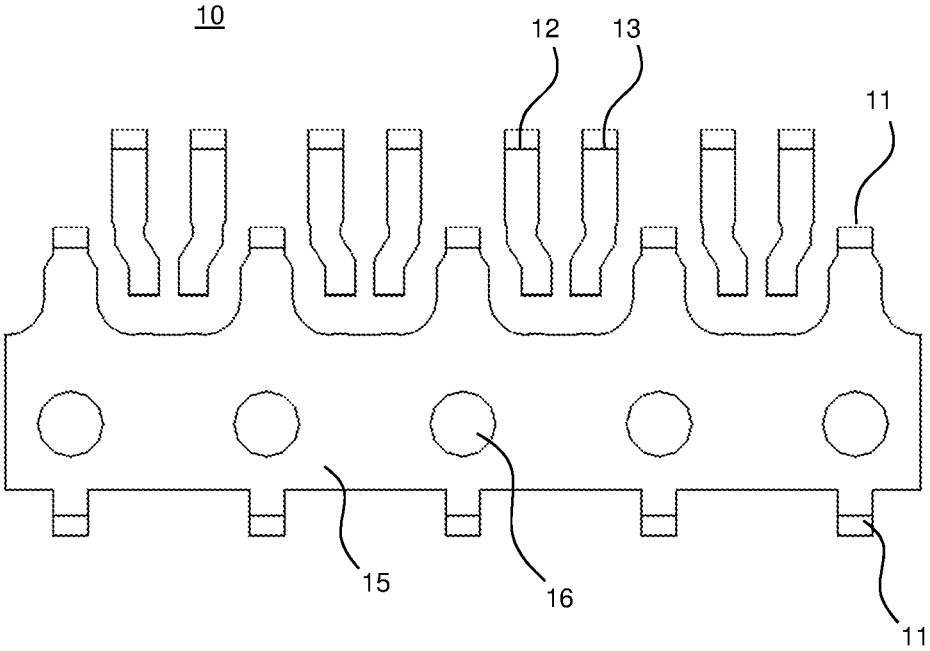
FIGS. 3 and 4 are views of the contact ribbon shown in FIGS. 1 and 2 with the tie bars removed.
Figure 4:
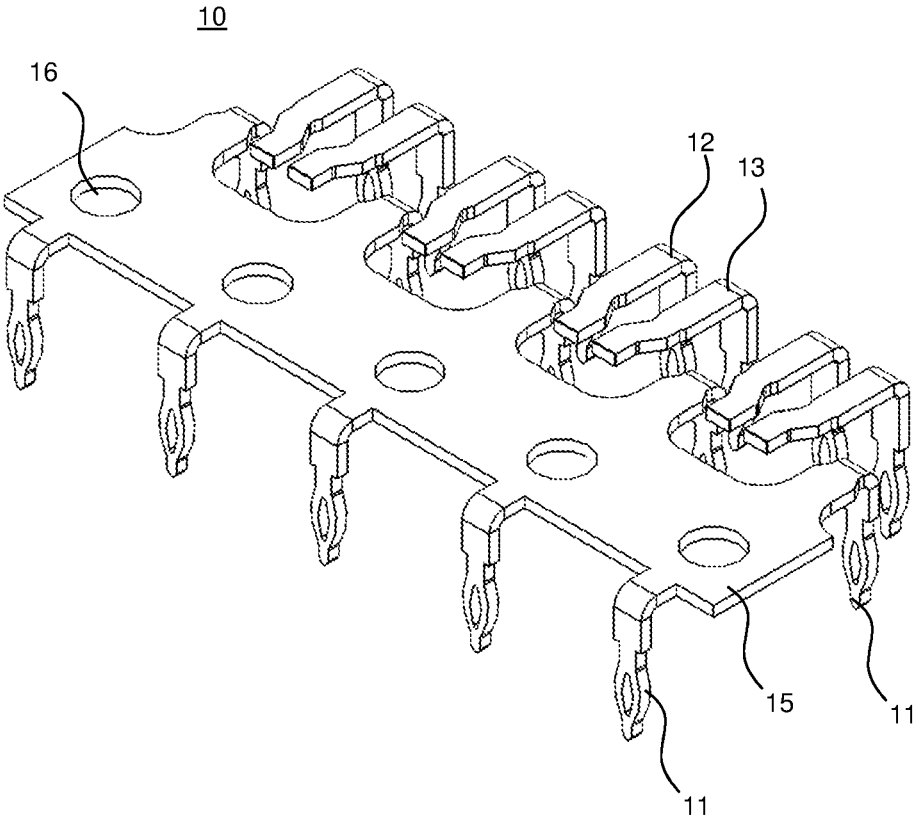
Figure 17:
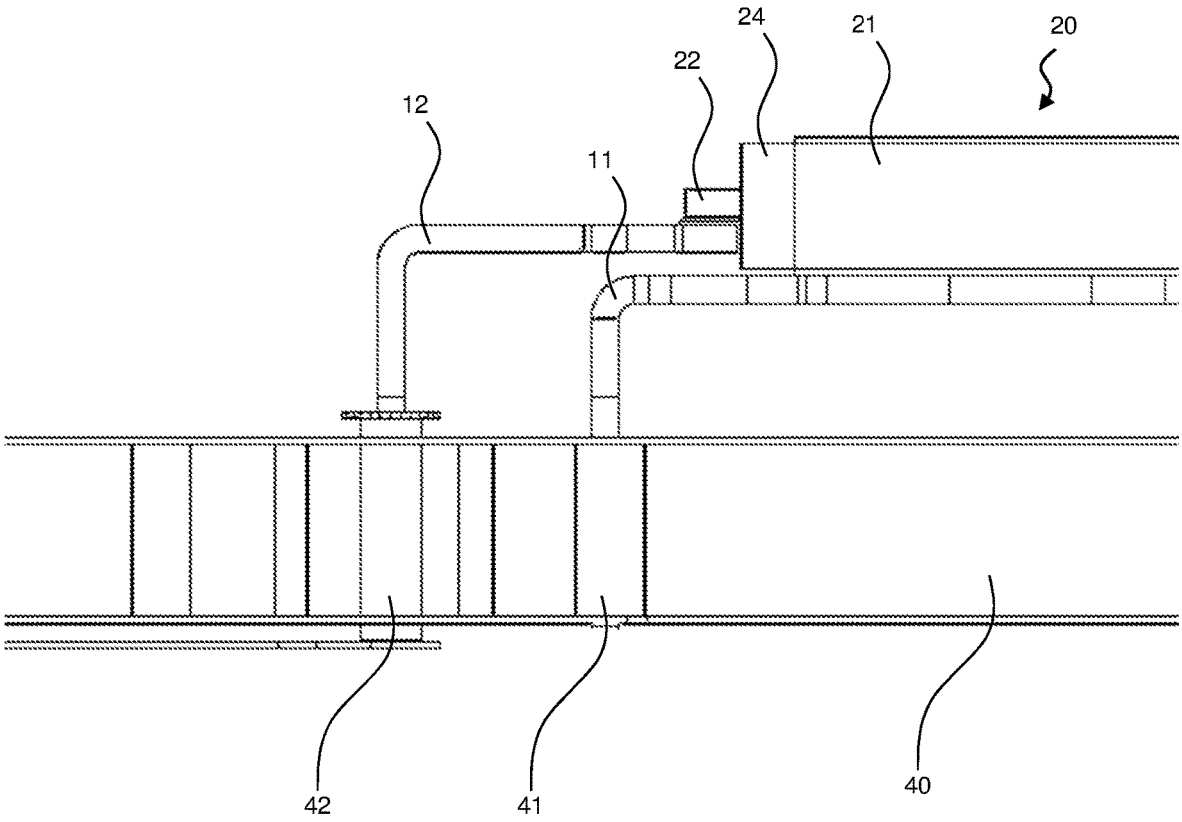
FIG. 17 is a cross-sectional view of the connector shown in FIGS. 15 and 16 mounted to a substrate.
Figure 18:
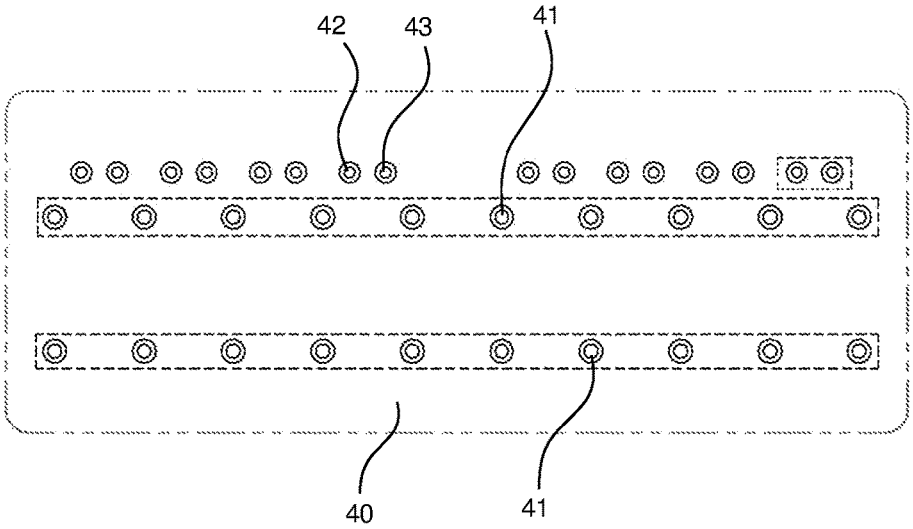
FIG. 18 is a plan view of the mounting hole layout of the substrate shown in FIG. 17.

FIGS. 1 and 2 show a contact ribbon 10 according to a preferred embodiment of the present invention. The contact ribbon 10 includes one or more ground contacts 11, one or more first contacts 12, and one or more second contacts 13 to provide physical and electrical connections to, for example, a substrate or an electrical connector. The first contacts 12 and the second contacts 13 are preferably aligned with respect to each other in a single row. Aligning the first contacts 12 and the second contacts 13 in a single row ensures that the overall transmission length for each of the signals transmitted by the high-speed cable assembly is the same or substantially the same, within manufacturing tolerances. Tie bars 14 connect the first and second contacts 12 and 13 together to provide a rigid structure that structurally supports the first and second contacts 12 and 13 during manufacturing and assembling of the high-speed cable assembly. The ground contacts 11 are connected together by a ground plane 15, which includes pilot holes 16 that provide guidance to stamp the contact ribbon 10. Preferably, the first and second contacts 12 and 13 are also initially connected to the ground plane 15 to provide additional structural support during manufacturing and assembling of the high-speed cable assembly. The contact ribbon 10 preferably includes two rows of ground contacts 11, which provide mechanical stability for the connector when it is mounted to a substrate (for example, substrate 40 as shown in FIGS. 17 and 18). A line extending through the first row of ground contacts 11 does not intersect with any of the first and second contacts 12 and 13, and a line extending through the second row of ground contacts 11 does not intersect with any of the first and second contacts 12 and 13.

Figure 7:
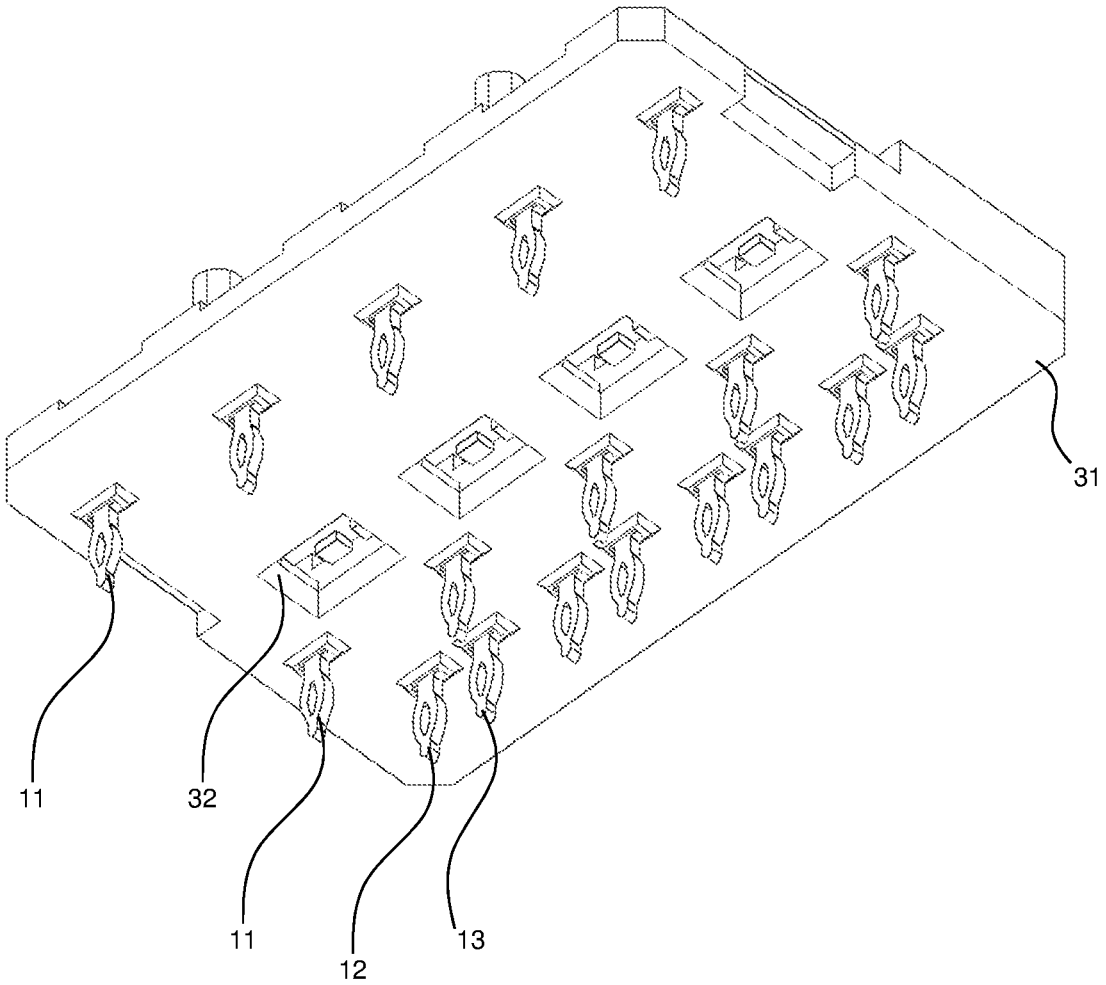
Figure 8:
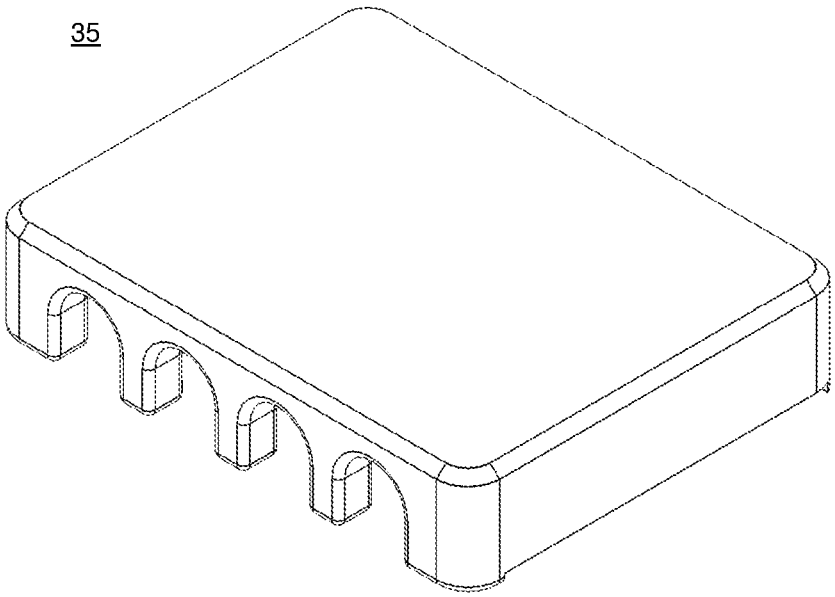
FIGS. 8 and 9 are views of an upper housing.
Figure 9:
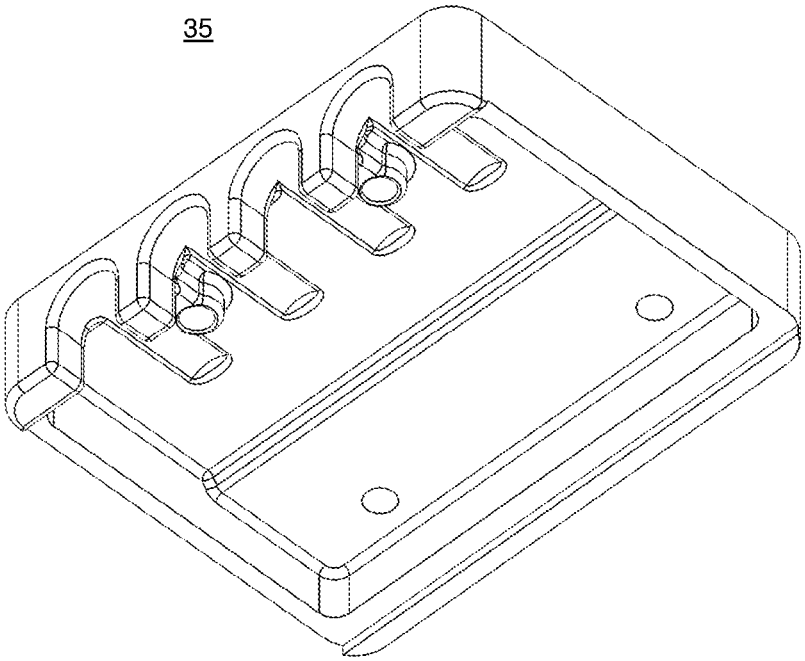
Figure 10:
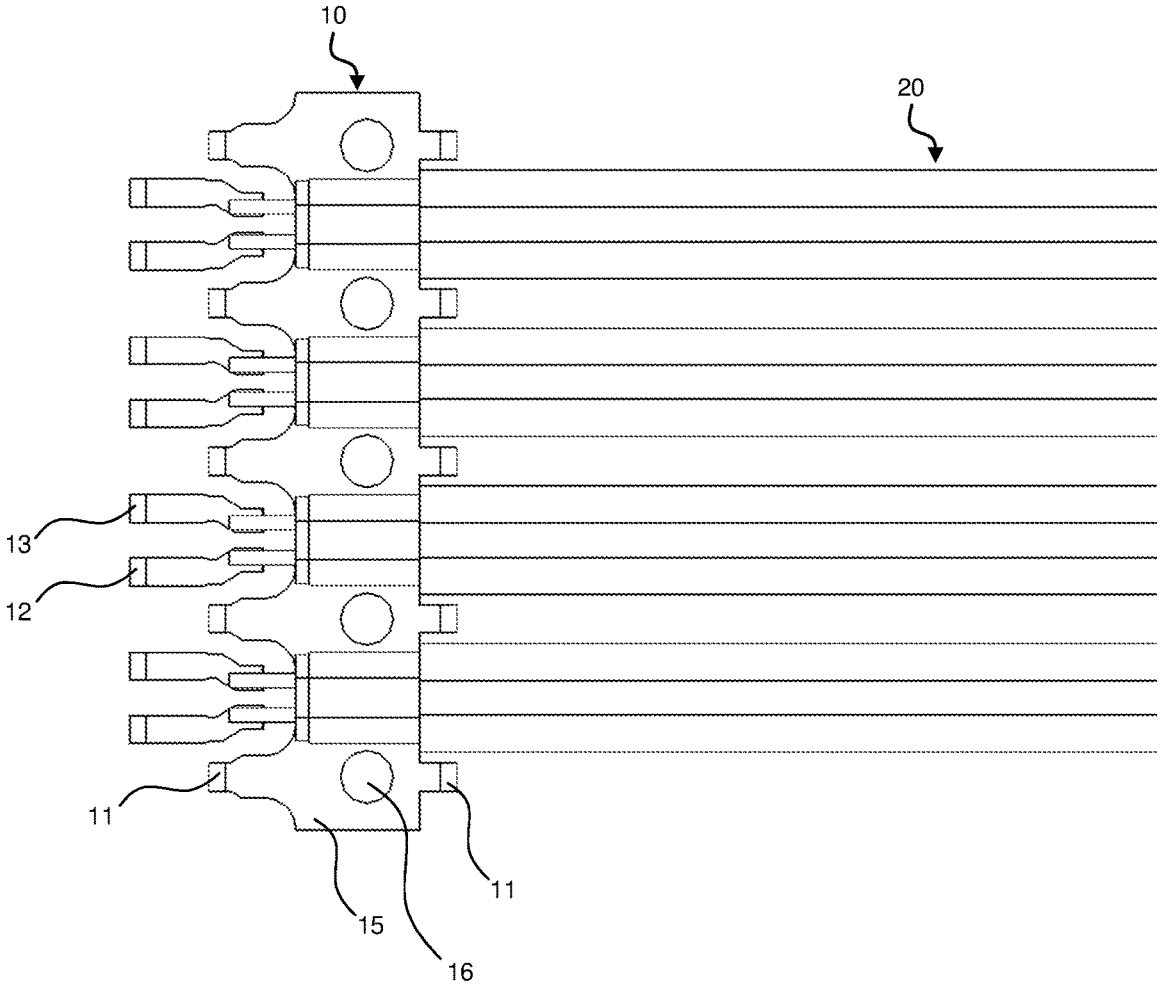
FIGS. 10-13 are views of cables connected to the contact ribbon shown in FIGS. 1 and 2.
Figure 11:
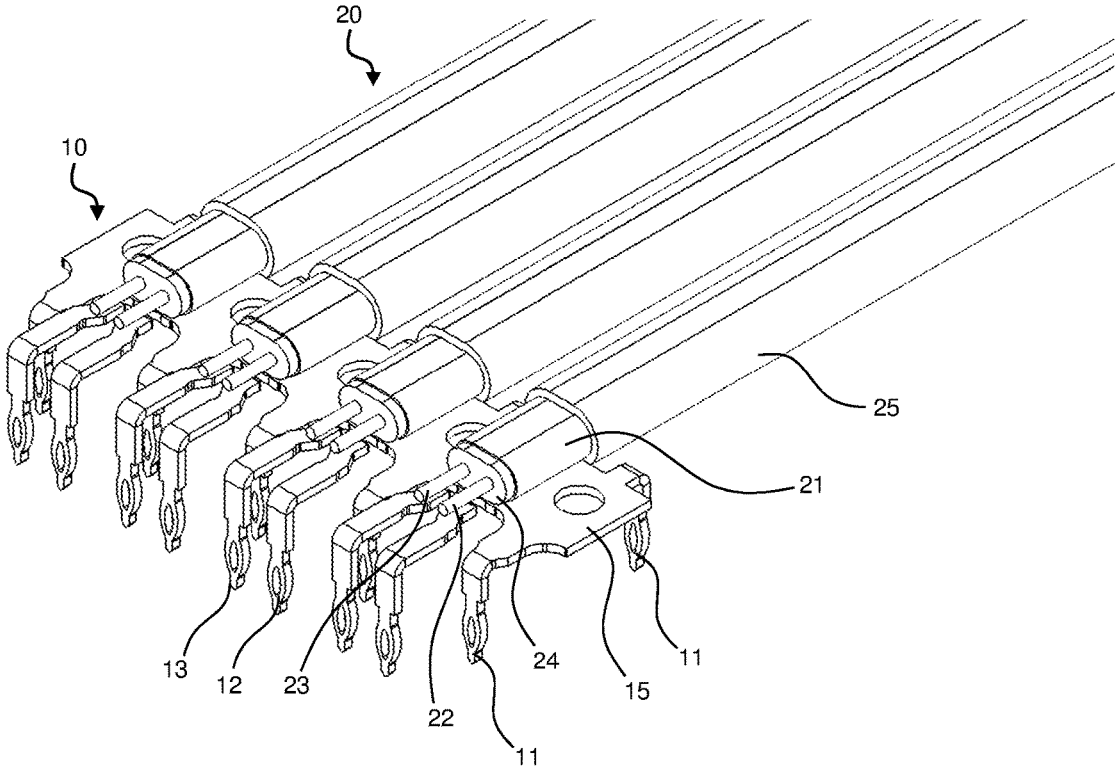
Figure 12:
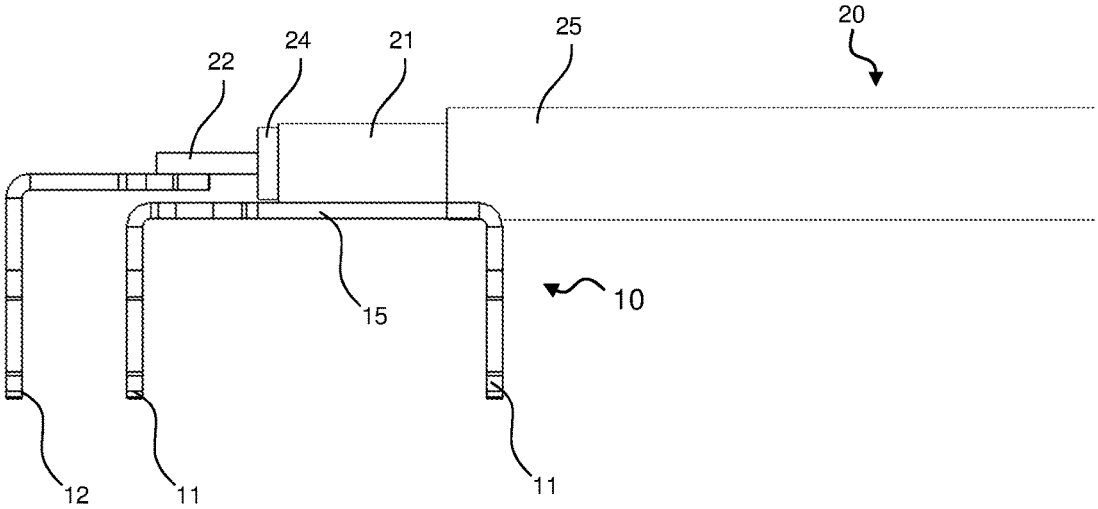
Figure 13:
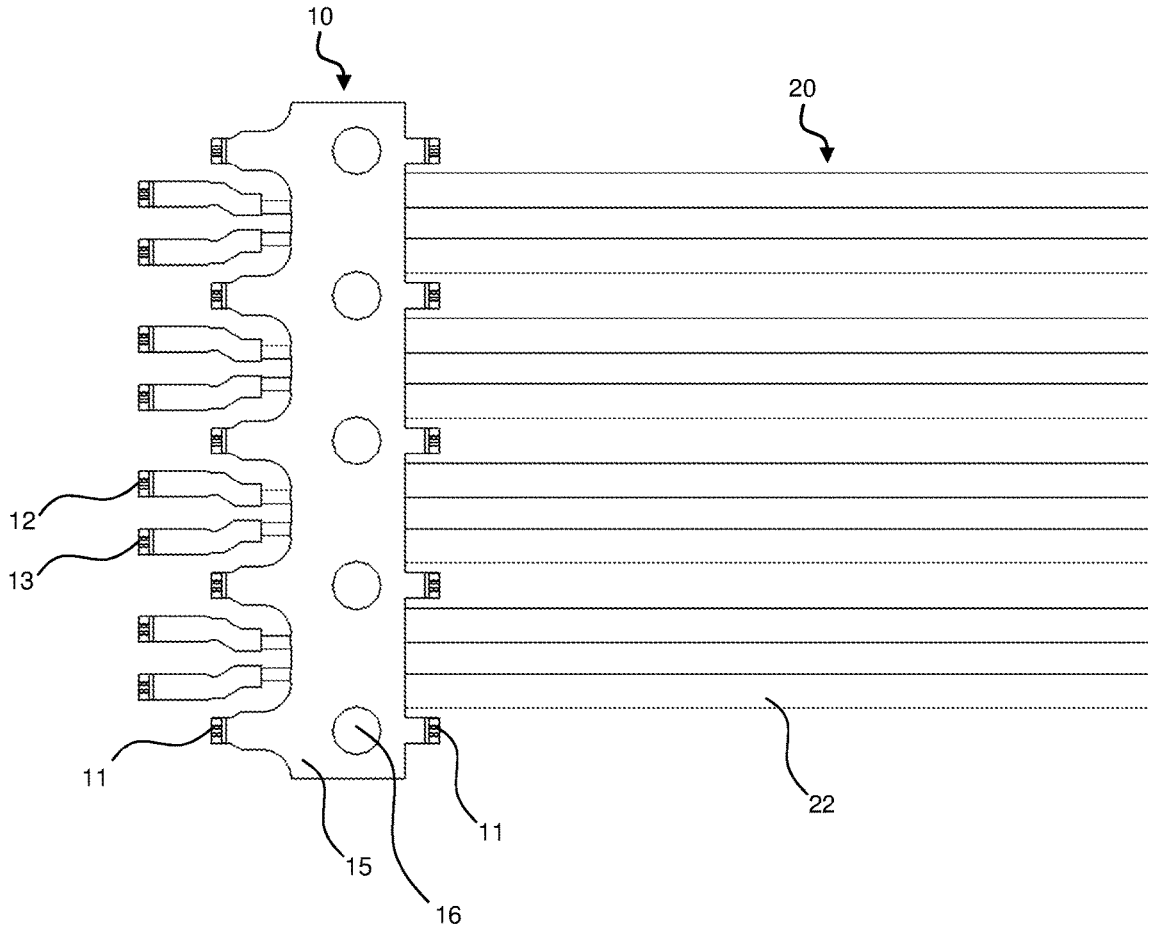
Figure 14:
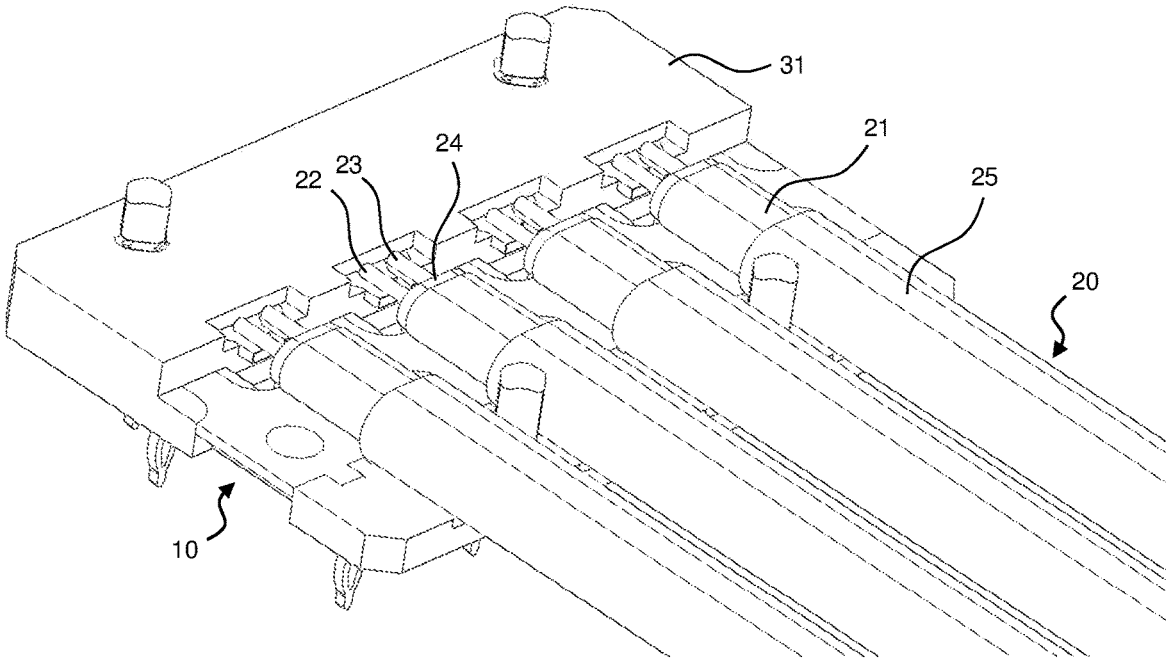
FIG. 14 is a view of a connector sub-assembly including the contact ribbon shown in FIGS. 1 and 2 connected to the cables shown in FIGS. 10-13 and mounted to the lower housing shown in FIGS. 5-7.

As shown in FIG. 7, the contact ribbon 10 can generally include three parallel, spaced apart linear arrays of contacts. A first linear array, row, or column of contacts is positioned immediately adjacent to a second linear array, row, or column of contacts and is spaced apart from the second linear array by a first distance. A third linear array, row, or column of contacts is spaced apart from the second linear array of contacts by a second distance that is greater than the first distance. The second distance can be at least two times the first distance. No contacts are positioned between the first linear array of contacts, between the second linear array of contacts or between the second linear array of contacts and the third linear array of contacts. A first contact of the second linear array and a first contact of the third linear array lie along a first line that is perpendicular or substantially perpendicular within manufacturing tolerances to the second and third linear arrays of contacts. A second contact of the second linear array and a second contact of the third linear array lie along a second line that is perpendicular or substantially perpendicular within manufacturing tolerances to the second and third linear arrays of contacts, parallel to the first line, and spaced apart from the first line. A third contact of the second linear array and a third contact of the third linear array lie along a third line that is perpendicular or substantially perpendicular within manufacturing tolerances to the second and third linear arrays of contacts, parallel to the first and second lines, and spaced apart from the first line and the second line.

Two immediately adjacent first and second contacts of the first linear array are positioned between the first line and the second line, do not touch the first or second lines, and do not overlap the first contacts of the first or second linear arrays or the second contacts of the first or second linear arrays. Two immediately adjacent third and fourth contacts of the first linear array are positioned between the second line and the third line, do not touch the second or third lines, and do not overlap the second contacts of the first or second linear arrays or the third contacts of the first or second linear arrays.

The two immediately adjacent first and second contacts of the first linear array are each spaced apart by a third distance that is less than a fourth distance between two immediately adjacent contacts in the second linear array or between two immediately adjacent contacts in the third linear array. The contacts on the first linear array may be arranged in a first group of two, three, four, five, six, seven etc. evenly spaced pairs of contacts adjacent to a first end of the contact ribbon 10, a second group of two, three, four, five, six, seven, etc. evenly spaced pairs of contacts adjacent to a second end of the contact ribbon 10, and a distance between the first and second groups that is larger than the first distance. The first contact of the two immediately adjacent first and second contacts of the first linear array and the first contact of the second linear array both lie along a first cross-array line that forms an acute angle with the first line. The acute angle can be 1 to 89 degrees with 45 degrees preferred, the second contact of the two immediately adjacent first and second contacts of the first linear array and the second contact of the second linear array both lie along a second cross-array line that forms an acute angle with the second line. The first linear array can be signal conductors arranged into differential signal pairs, and the second and third linear arrays can be ground shield tails attached to one or more ground shields. The number of contacts in the first linear array is greater than the number of contacts in the second linear array. The number of contacts in the second and third linear arrays can be equal. For example, the first linear array can include sixteen contacts arranged into two groups of differential signal pairs, while the second or third linear arrays can each include ten contacts.

As shown in FIGS. 1 and 2, ground contacts 11, the first contacts 12, and the second contacts 13 are preferably included in a ribbon, that is, the contact ribbon 10, and arranged such that individual contacts 11, 12, and 13 can be formed by cutting the first and second contacts 12 and 13 from the ground plane 15 and removing the tie bars 14 that connect the first and second contacts 12 and 13. The first and second contacts 12 and 13 preferably include a concave portion (not shown) that defines a groove to receive, for example, center conductors of coaxial or twinaxial cables. Preferably, the legs of ground contacts 11, first contacts 12, and second contacts 13 include a through-hole (e.g., an "eye-of-the-needle" configuration) to provide an oversize fit for press-fit mounting applications. Accordingly, when the legs are press-fit into corresponding mounting holes in a substrate (for example, substrate 40 as shown in FIGS. 17 and 18), the legs deform to fit the corresponding mounting holes in the substrate to provide a secure electrical and mechanical connection between the contacts 11, 12, and 13 and the substrate. However, other configurations can be used for the legs of ground contacts 11, first contacts 12, and second contacts 13, such as solderable contacts, pogo pins, one-piece contact solutions, two-piece contact solutions, compression contacts, pin and socket contacts, single-beam contacts, dual-beam contacts, multi-beam contacts, elastomeric contacts, directly soldered solutions, crimped contacts, welded contacts, etc. Other configurations that can be used with the preferred embodiments of the present invention include, for example, a square post, a kinked pin, an action pin, a Winchester C-Press® compliant pin, or any other suitable configuration. That is, any contact can be used that is connected to the substrate by heat, plastic deformation, or elastic deformation.

FIGS. 1-16 show a process of providing the high-speed cable assembly according to a preferred embodiment of the present invention. As shown in FIGS. 1 and 2, the first and second contacts 12 and 13 are cut or stamped so that they are no longer connected to the ground plane 15 of the contact ribbon 10. The number of contacts 12 and 13 that are cut preferably corresponds to the number of contacts in the high-speed cable assembly. Preferably, not all of the contacts 12 and 13 are cut such that the rigid structure is maintained for the contact ribbon 10 during assembly and further manufacturing of the high-speed cable assembly. Further, one or more of the first and second contacts 12 and 13 can be left connected to the ground plane 15 to provide additional ground connection(s).

Figure 5:
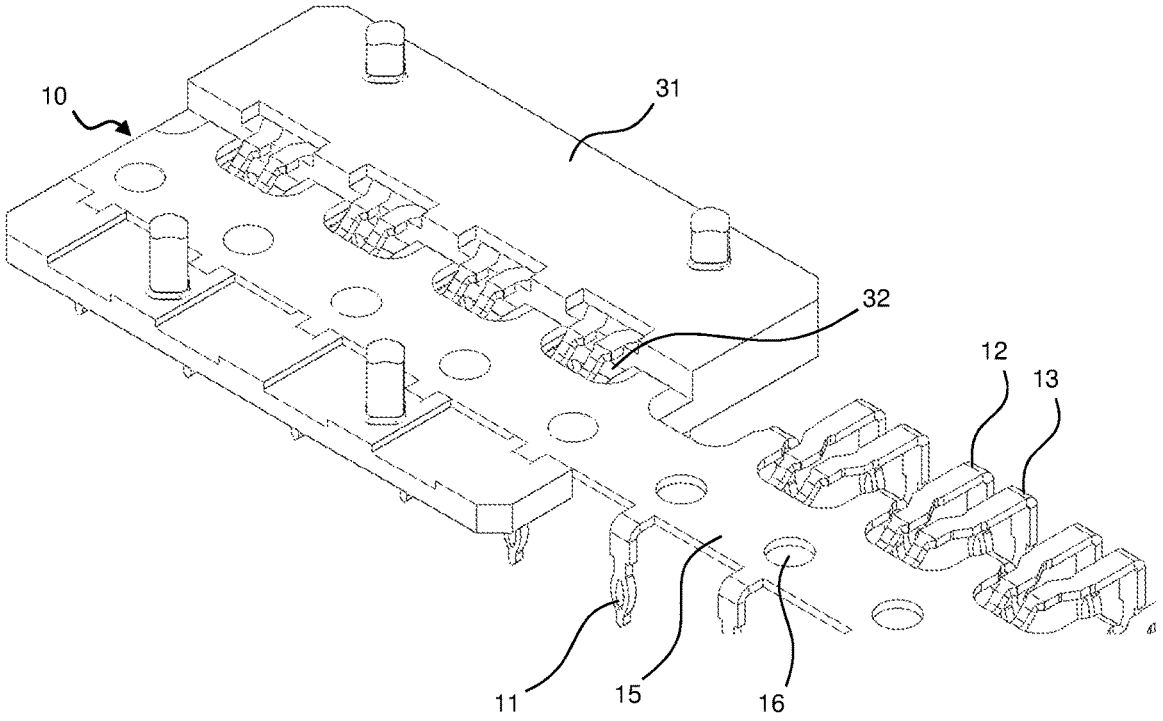
FIGS. 5-7 are views of the contact ribbon shown in FIGS. 1 and 2 mounted to a lower housing.
Figure 6:
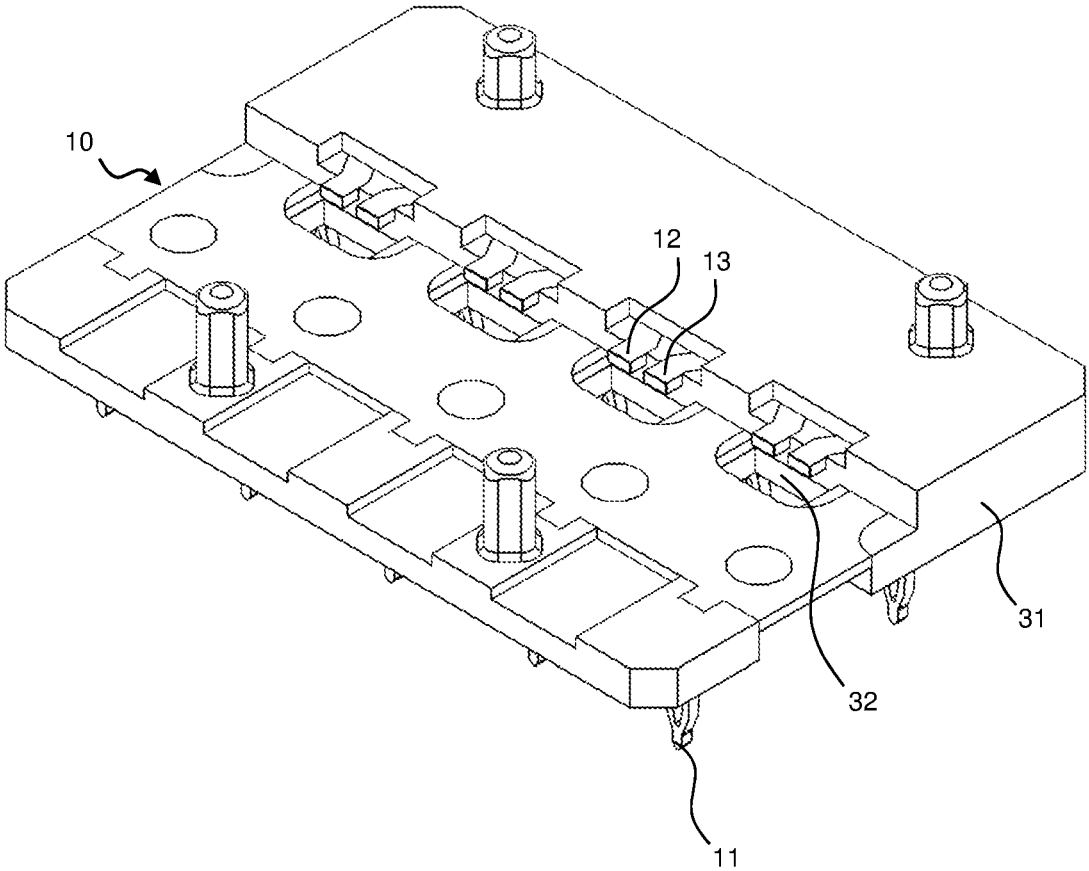

As shown in FIGS. 5-7, the contact ribbon 10 is inserted into a lower connector housing 31, or the lower connector housing 31 is molded around the contact ribbon 10. Preferably, the lower connector housing 31 is overmolded on the contact ribbon 10 to form an electrical connector of the high-speed cable assembly. The lower connector housing 31 is formed with through holes 32 that are arranged over the tie bars 14 of the contact ribbon 10 when the lower connector housing 31 is molded over the contact ribbon 10. As shown in FIGS. 4-7, after overmolding the lower connector housing 31 on the contact ribbon 10, the tie bars 14 are removed, preferably by a tool punching into the through holes 32 of the lower connector housing 31. Further, the portions of the contact ribbon 10 that laterally overhang from the lower connector housing 31 are removed, preferably by cutting or stamping. Accordingly, the first contacts 12 and the second contacts 13 are structurally and electrically disconnected from each other and from the ground plane 15. Preferably, because the lower connector housing 31 is overmolded on the contact ribbon 10, the lower connector housing 31 is solid and rigidly supports the connections between the contact ribbon 10 and the twinaxial cable 20. Additionally, the lower connector housing 31 can include shelf features, retention elements, and/or alignment features that help support the press-in force to retain the contact ribbon 10 within the lower connector housing 31.

During the overmolding of the contact ribbon 10, both sides of each contact 12, 13 can be stabilized so that the contacts 12, 13 cannot move while the plastic is being injected around the contacts 12, 13, which can improve mechanical and electrical performance of the contacts 12, 13. Stabilizing the contacts 12, 13 can create void cores in the lower connector housing 31. These void cores can lower the dielectric constant in the region where the contacts 12, 13 are exposed to air. The void cores can be located where the cable 20 is attached to the contacts 12, 13. When the center conductors 22, 23 are soldered to the contacts 12, 13 at the void cores, the air gaps created by the void cores lower the dielectric constant while the solder balances out the local impedance with added capacitance.

Instead of using overmolding for the lower connector housing 31, any housing can be used that allows the tie bars 14 between the first contacts 12 and second contacts 13 to be removed. Such housings include, for example, pre-molded, snap-on, sonically welded, screwed-on, and glued housings. However, overmolding is preferred for the lower connector housing 31 because of its simplicity and because it is easier for a tool to remove the tie bars 14. Preferably, the lower connector housing 31 is made of plastic, for example, acrylonitrile butadiene styrene (ABS) plastic.

As shown in FIGS. 10-14, the contact ribbon 10 is connected to a twinaxial cable 20. Each twinaxial cable 20 includes a shield 21, a first center conductor 22, a second center conductor 23, an insulator 24, and a jacket 25. The first and second center conductors 22 and 23 are surrounded by the insulator 24, the insulator 24 is surrounded by the shield 21, and the shield 21 is surrounded by the jacket 25. For clarity, FIGS. 10-13 do not show lower connector housing 31.

The shield 21 and the first and second center conductors 22 and 23 are the conductive elements of the twinaxial cable 20. The first and second center conductors 22 and 23 are arranged to carry electrical signals, whereas the shield 21 typically provides a ground connection. The shield 21 also provides electrical isolation for the first and second center conductors 22 and 23 and reduces crosstalk between neighboring pairs of the first and second center conductors 22 and 23 and between the conductors of any neighboring cables.

The first and second center conductors 22 and 23 preferably have cylindrical or substantially cylindrical shapes. However, the first and second center conductors 22 and 23 could have rectangular or substantially rectangular shapes or other suitable shapes. The first and second center conductors 22 and 23 and the shield 21 are preferably made of copper. However, the first and second center conductors 22 and 23 and the shield 21 can be made of brass, silver, gold, copper alloy, any highly conductive element that is machinable or manufacturable with a high dimensional tolerance, or any other suitable conductive material. The insulator 24 is preferably formed of a dielectric material with a constant or substantially constant cross-section to provide constant or substantially constant within manufacturing tolerances electrical properties for the conductors 22 and 23. The insulator 24 could be made of TEFLON™, FEP (fluorinated ethylene propylene), air-enhanced FEP, TPFE, nylon, combinations thereof, or any other suitable insulating material. The insulator 24 preferably has a round, oval, rectangular, or square cross-sectional shape, but can be formed or defined in any other suitable shape. The jacket 25 protects the other layers of the twinaxial cable 20 and prevents the shield 21 from coming into contact with other electrical components to significantly reduce or prevent occurrence of an electrical short. The jacket 25 can be made of the same materials as the insulator 24, FEP, or any suitable insulating material.

As shown in FIGS. 10-12 and 14, portions of the first and second center conductors 22 and 23, the insulator 24, and the shield 21 are exposed before the twinaxial cable 20 is connected to the contact ribbon 10. The first and second center conductors 22 and 23 are connected to the respective first and second contacts 12 and 13 of the contact ribbon 10. The first and second center conductors 22 and 23 are preferably fusibly connected (for example, by solder) to the first and second contacts 12 and 13 to ensure an uninterrupted electrical connection. Preferably, a hot-bar soldering or other soldering technique is used. However, it is possible to use other suitable methods to connect the first and second center conductors 22 and 23 to the first and second contacts 12 and 13, e.g., crimping, sonically welding, conductive soldering, convective soldering, inductive soldering, radiation soldering, otherwise melting solder to hold the two parts together, pushing the two parts together with enough force to weld the two parts together, or micro-flaming. Preferably, the shield 21 is connected with the ground plane 15 by a hot-bar soldering process, although the shield 21 and the ground plane 15 can be connected by other processes, including the process described above with respect to the first and second center conductors 22 and 23 and the first and second contacts 12 and 13. The pilot holes 16 in the ground plane 15 improve the solder connection between the shield 21 and the ground plane 15 by increasing the area through which solder can flow. The connections between the first and second contacts 12 and 13 to the first and second center conductors 22 and 23 and between the shield 21 and the ground plane 15 can occur either simultaneously or successively. In addition, the first and second contacts 12 and 13 can be connected to the first and second center conductors 22 and 23 and the shield 21 can be connected to the ground plane 15 after the lower connector housing 31 is formed.

Other types of cables, such as coaxial cables, can be used in place of the twinaxial cable 20. In addition, the twinaxial cable 20 can be provided as a ribbonized twinaxial cable, and the ribbonized twinaxial cable can include a single shield that surrounds more than one pair of first and second center conductors 22 and 23.

As shown in FIGS. 8, 9, 15, and 16, an upper connector housing 35 is preferably attached to the lower connector housing 31 to form a completed connector. The upper connector housing 35 protects the components of the completed connector to improve the reliability of the completed connector. In addition, the upper connector housing 35 can include cosmetic features.

Figure 15:
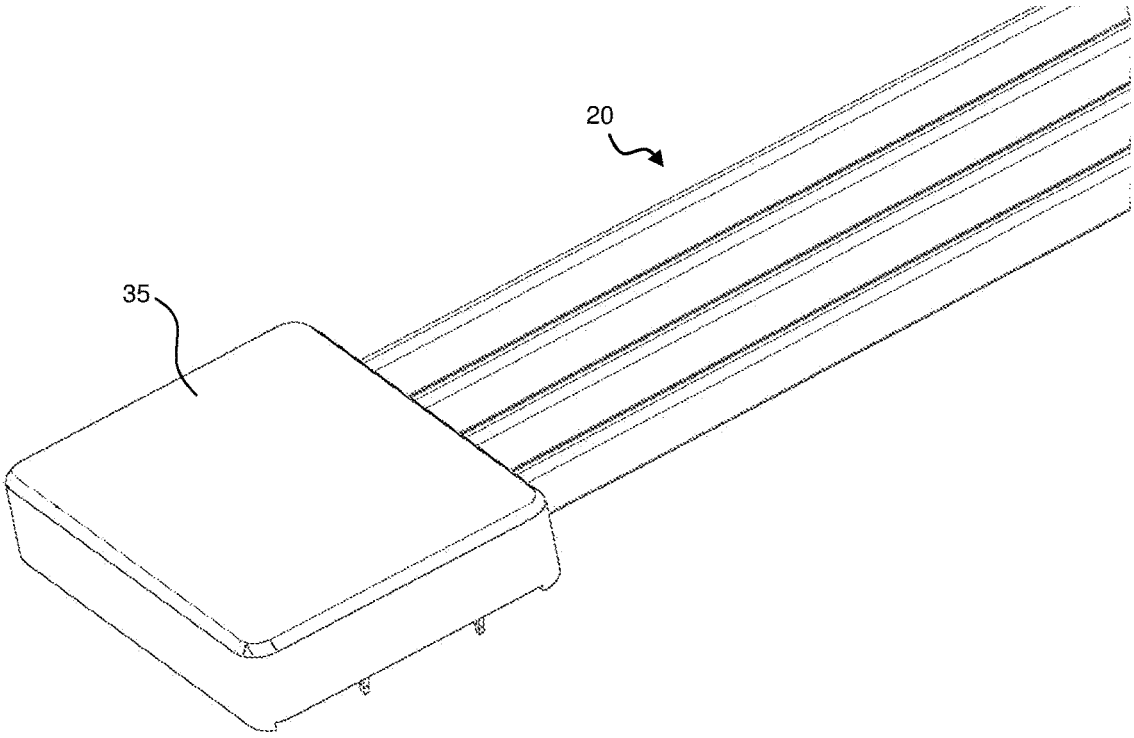
FIGS. 15 and 16 are views of the completed connector when the upper housing shown in FIGS. 8 and 9 is attached to the connector sub-assembly shown in FIG. 14.
Figure 16:
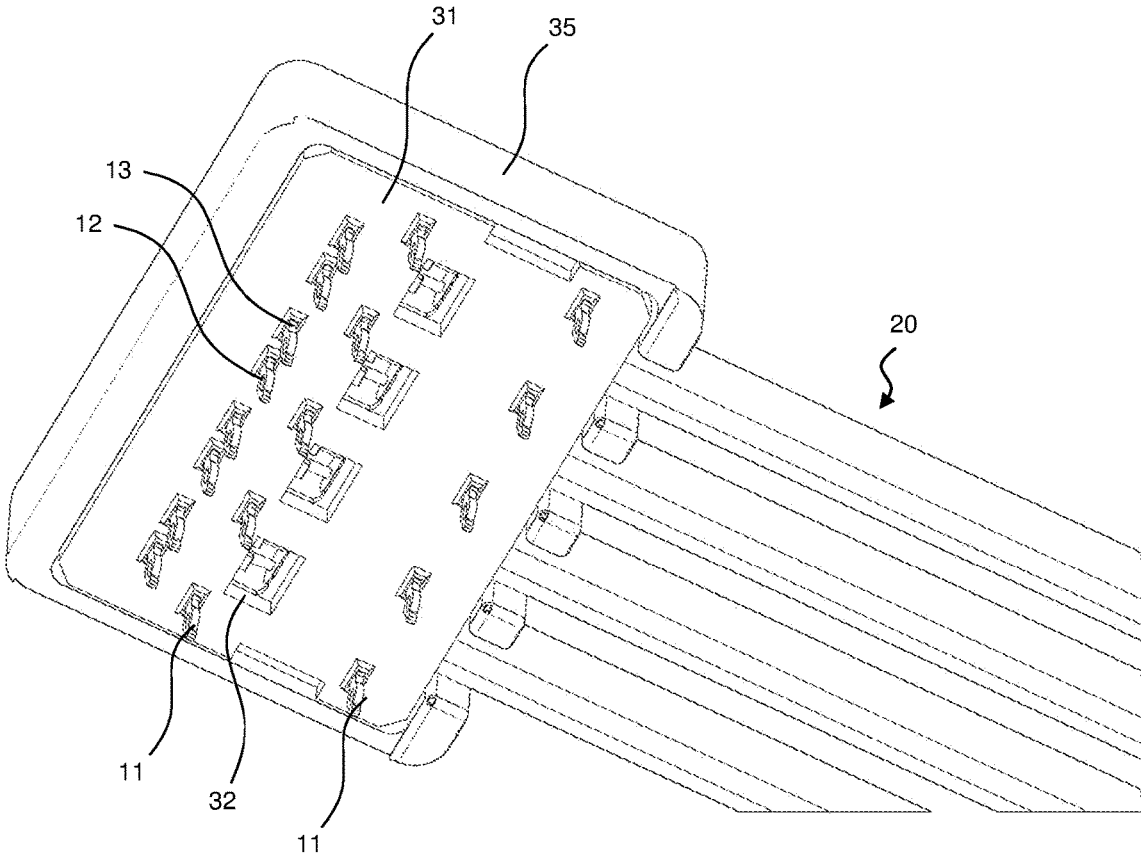

FIG. 17 is a cross-sectional view of the completed connector shown in FIGS. 15 and 16 mounted to a substrate 40.

The lower connector housing 31 and the upper connector housing 35 are not shown in FIG. 17, for clarity. The ground contact 11 can be press fit into ground mounting hole 41. The mounting hole 41 can be connected to one or more ground planes in the substrate 40. The one or more ground planes can have anti-pads through which mounting holes 42, 43 extend. The contacts 12, 13 (only contact 12 is visible in FIG. 17) can be press fit into mounting holes 42, 43 (only mounting hole 42 is visible in FIG. 17). The mounting holes 42, 43 can have annular rings at the surface of the substrate 40. The mounting holes 42, 43 can be connected to signal lines in the substrate 40. The substrate 40 can include extra ground vias to reduce loop inductance and to provide extra retention to prevent delamination. Via diameters, via thicknesses, annular rings of the vias, annular-ring thickness, anti-pad geometry, and back-drilling can all be optimized to optimize signal-integrity performance.

FIG. 18 is a plan view of the mounting hole layout of the substrate 40 shown in FIG. 17. Preferably, the completed connector is connected by press-fitting or soldering to the substrates 40, according to whether the press-fit or solderable contacts are used. As shown in FIG. 18, the substrate 40 preferably includes a connector footprint of two rows of ground mounting holes 41 and a row of alternating first mounting holes 42 and second mounting holes 43. The ground mounting holes 41 receive the ground contacts 11, the first mounting holes receive the first contacts 12, and the second mounting holes receive the second contacts 13. Preferably, the first mounting holes 42 and the second mounting holes 43 are aligned with respect to each other in a single row to correspondingly mate with the first contacts 12 and the second contacts 13. The ground mounting holes 41 are preferably arranged in first and second rows. A line extending through the first row of ground mounting holes 41 does not intersect with any of the first mounting holes 42 and the second mounting holes 43, and a line extending through the second row of ground mounting holes 41 does not intersect with any of the first mounting holes 42 and the second mounting holes 43.

As similarly shown in FIG. 18, the connector footprint can generally include three parallel, spaced apart linear arrays of plated through holes (PTHs) or solder pads. A first linear array, row, or column of PTHs or solder pads is positioned immediately adjacent to a second linear array, row, or column of PTHs or solder pads and is spaced apart from the second linear array by a first distance. A third linear array, row, or column of PTHs or solder pads is spaced apart from the second linear array of PTHs or solder pads by a second distance that is greater than the first distance. The second distance can be at least two times the first distance. No PTHs or solder pads are positioned between the first linear array of PTHs or solder pads, between the second linear array of PTHs or solder pads or between the second linear array of PTHs or solder pads and the third linear array of PTHs or solder pads. A first PTH or solder pad of the second linear array and a first PTH or solder pad of the third linear array lie along a first line that is perpendicular or substantially perpendicular within manufacturing tolerances to the second and third linear arrays of PTHs or solder pads. A second PTH or solder pad of the second linear array and a second PTH or solder pad of the third linear array lie along a second line that is perpendicular or substantially perpendicular within manufacturing tolerances to the second and third linear arrays of PTHs or solder pads, parallel to the first line, and spaced apart from the first line. A third PTH or solder pad of the second linear array and a third PTH or solder pad of the third linear array lie along a third line that is perpendicular or substantially perpendicular within manufacturing tolerances to the second and third linear arrays of PTHs or solder pads, parallel to the first and second lines, and spaced apart from the first line and the second line.

Two immediately adjacent first and second PTHs or solder pads of the first linear array are positioned between the first line and the second line, do not touch the first or second lines, and do not overlap the first PTHs or solder pads of the first or second linear arrays or the second PTHs or solder pads of the first or second linear arrays. Two immediately adjacent third and fourth PTHs or solder pads of the first linear array are positioned between the second line and the third line, do not touch the second or third lines, and do not overlap the second PTHs or solder pads of the first or second linear arrays or the third PTHs or solder pads of the first or second linear arrays.

The two immediately adjacent first and second PTHs or solder pads of the first linear array are each spaced apart by a third distance that is less than a fourth distance between two immediately adjacent PTHs or solder pads in the second linear array or between two immediately adjacent PTHs or solder pads in the third linear array. The PTHs or solder pads on the first linear array may be arranged in a first group of two, three, four, five, six, seven etc. evenly spaced pairs of PTHs or solder pads adjacent to a first end of the connector footprint, a second group of two, three, four, five, six, seven, etc. evenly spaced pairs of PTHs or solder pads adjacent to a second end of the connector footprint, and a distance between the first and second groups that is larger than the first distance. The first PTH or solder pad of the two immediately adjacent first and second PTHs/solder pads of the first linear array and the first PTH or solder pad of the second linear array both lie along a first cross-array line that forms an acute angle with the first line. The acute angle can be 1 to 89 degrees with 45 degrees preferred, the second PTH or solder pad of the two immediately adjacent first and second PTHs/solder pads of the first linear array and the second PTH or solder pad of the second linear array both lie along a second cross-array line that forms an acute angle with the second line. The first linear array can be signal conductors arranged into differential signal pairs, and the second and third linear arrays can be ground shield tails attached to one or more ground shields. The number of PTHs/solder pads in the first linear array is greater than the number of PTHs/solder pads in the second linear array. The number of PTHs/solder pads in the second and third linear arrays can be equal. For example, the first linear array can include sixteen PTHs/solder pads arranged into two groups of differential signal pairs, while the second or third linear arrays can each include ten PTHs/solder pads.

Preferably, the completed connector is press fit to the substrate 40 using a press-fit tool. The press-fit tool is preferably a simple tool, including, for example, a flat block attached to an arbor press, a tool with a cavity that aligns with the housing, a tap hammer, etc. That is, it is not necessary to use an expensive tool to transfer a force directly and individually to the back of each of the contacts 11, 12, and 13. Typically, the completed connector is only mated to the substrate 40 once; however, it is possible to unmate the completed connector and the substrate 40 and then to re-mate the completed connector and the substrate 40, if desired. For example, it is possible to remove the press-fit contacts 11, 12, and 13.

According to the preferred embodiments of the present invention, the first contacts 12 and the second contacts 13 are offset from ground plane 15, as shown in FIGS. 2, 5, 11, 12, and 17. This provides a shortened connection between the contacts 12 and 13 and the center conductors 22 and 23, due to a very small length of the center conductors 22 and 23 being exposed (for example, about 20 mil). Accordingly, a transition region between the twinaxial cable 20 and the connector is significantly reduced or minimized, which provides high signal integrity for signals transmitted to and from the twinaxial cable 20 and the substrate 40. In particular, the preferred embodiments of the present invention provide a connector with a low return loss, which is a loss of power in a signal due to the signal being at least partially returned or reflected by a discontinuity in the transmission line (e.g., due to an impedance mismatch). In addition, the exposed insulator 24 of the twinaxial cable 20 can be used as a reference point for locating the center conductors 22 and 23 to the contacts 12 and 13, which simplifies manufacturing of the connector. In this regard, the first contacts 12 and the second contacts 13 can also be angled or bent to further improve the connection to the first center conductor 22 and the second center conductor 23 of the twinaxial cable.

Also, according to the preferred embodiments of the present invention, the first contacts 12 and the second contacts 13 are aligned in a single row, such that the overall length of the transmission for each signal is the same or substantially the same, within manufacturing tolerances. This provides "balanced" contacts with a relatively consistent characteristic impedance and low cross-talk. Preferably, the preferred embodiments of the present invention allow for communication to be performed at about 20 GHz or more, for example. In addition, the center conductors 22 and 23 of the twinaxial cable 20 preferably transmit a differential signal.

Figure 19:
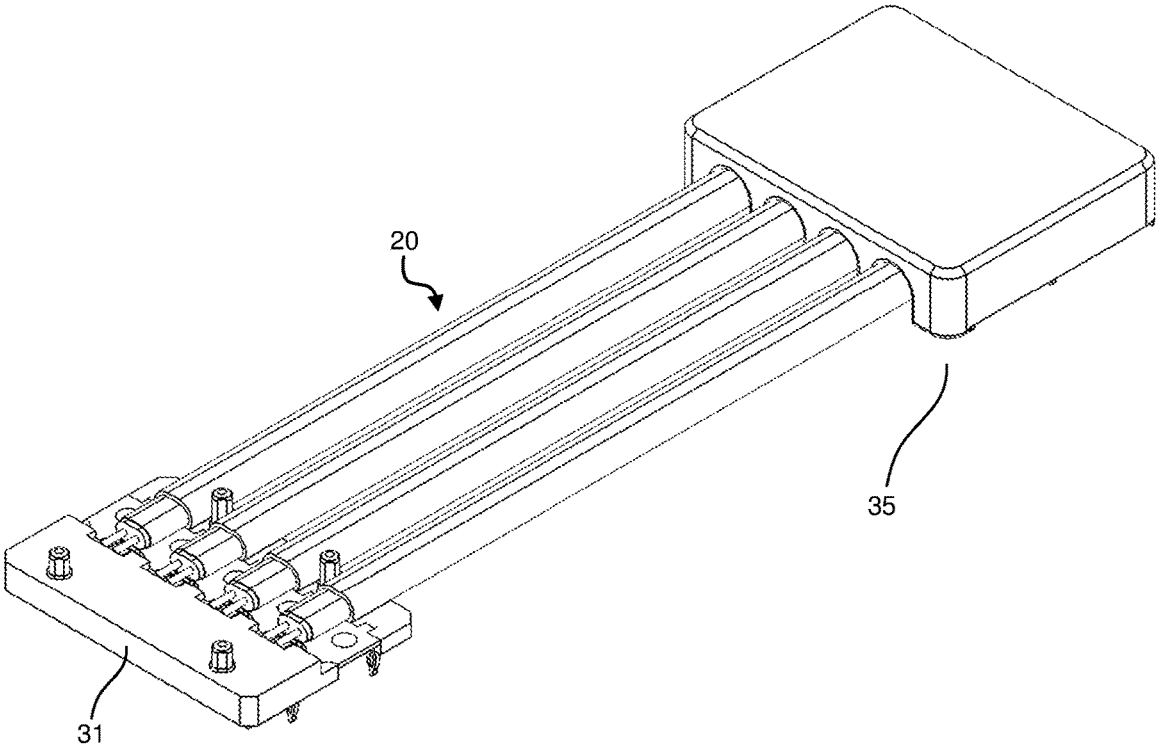
FIG. 19 is a view of a high-speed cable assembly according to a preferred embodiment of the present invention.

According to the preferred embodiments of the present invention, the completed connector can be used to connect the twinaxial cable to different points on the substrate 40, or to connect the substrate 40 to another substrate or to an electronic device. For example, as shown in FIG. 19, one or more twinaxial cables 20 can be terminated at both ends thereof by a completed connector. The upper connector housing 35 is not shown for one of the completed connectors in FIG. 19, for clarity.

As another example, in an edge-to-edge application, the substrate 40 can be connected to a substrate that is co-planar or substantially co-planar and aligned along a common edge. As another example, in a right-angle application, the substrate 40 can be connected to a substrate that is perpendicular or substantially perpendicular. According to a further example, in a board-to-board application, the substrate 40 can be connected to a substrate that is parallel or substantially parallel, but not coplanar, for example, when the surfaces of the substrates are facing each other. As yet another example, in a board-to-edge-card application, one end of the completed connector can be connected to a relatively large substrate, such as a computer motherboard, while another end of the completed connector is connected to a relatively small edge-card.

The cable assemblies of the preferred embodiments of the present invention achieve a simulated insertion loss of about −1 dB at frequencies up to and including about 23 GHz and a return loss at or under −20 dB at frequencies up to about 25 GHz. The cable assembly of the preferred embodiments of the present invention achieves power sum far end crosstalk (PSFEXT) of approximately −40 dB at frequencies up to and including 10 GHz. The cable assemblies of the preferred embodiments of the present invention achieve an integrated crosstalk noise (ICN) between 5.6 and 7.5 at a frequency of about 14 GHz for all measured differential pairs. The term "about" refers to measurement tolerances. For example, a frequency of "about 30 GHz" refers to a frequency that is measured to be 30 GHz within measurement tolerances.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A cable assembly comprising:

a contact ribbon defined by a single stamping including:

a plurality of pairs of first and second signal contacts;

a ground plane;

a first row of ground contacts extending from the ground plane in a row along a first side of the ground plane such that a first line extending through the first row of ground contacts does not intersect with any signal contacts of the plurality of pairs of first and second signal contacts; and a second row of ground contacts extending from the ground plane in a row along a second side of the ground plane such that a second line extending through the second row of ground contacts does not intersect with any signal contacts of the plurality of pairs of first and second signal contacts; and a cable including:

a plurality of pairs of first and second center conductors, each pair of the plurality of pairs of first and second center conductors is connected to a corresponding pair of the plurality of pairs of first and second signal contacts;

a plurality of insulators each surrounding a corresponding pair of the plurality of pairs of first and second center conductors; and a shield that surrounds the plurality of insulators and that is connected to the ground plane, wherein the second row of ground contacts is located on a same side of the contact ribbon as the plurality of pairs of first and second signal contacts.

2. The cable assembly according to claim 1, wherein the plurality of pairs of first and second signal contacts are arranged in a single row.

3. The cable assembly according to claim 2, wherein a first distance between the first row of ground contacts and the second row of ground contacts is greater than a second distance between the single row of the plurality of pairs of first and second signal contacts and either of the first row of ground contacts or the second row of ground contacts.

4. The cable assembly according to claim 1, wherein the first row of ground contacts and the second row of ground contacts are located on a same side of the plurality of pairs of first and second signal contacts.

5. The cable assembly according to claim 1, wherein:

the contact ribbon is included in a housing; and a support member connecting the plurality of pairs of first and second signal contacts is removed from the contact ribbon after the contact ribbon is included in the housing.

6. The cable assembly according to claim 1, wherein the cable is a twinaxial cable.

7. The cable assembly according to claim 1, wherein the plurality of pairs of first and second signal contacts are press-fit contacts or solderable contacts.

8. The cable assembly according to claim 1, wherein the first row of ground contacts and the second row of ground contacts are press-fit contacts or solderable contacts.

9. A method of manufacturing a cable assembly, comprising:

providing a contact ribbon including:

a plurality of pairs of first and second signal contacts;

a ground plane;

a first row of ground contacts extending from the ground plane in a row along a first side of the ground plane such that a first line extending through the first row of ground contacts does not intersect with any signal contacts of the plurality of pairs of first and second signal contacts; and a second row of ground contacts extending from the ground plane in a row along a second side of the ground plane such that a second line extending through the first row of ground contacts does not intersect with any signal contacts of the plurality of pairs of first and second signal contacts;

providing a cable with a plurality of pairs of first and second center conductors, a plurality of insulators each surrounding a corresponding pair of the plurality of pairs of first and second center conductors, and a shield that surrounds the plurality of insulators;

connecting each pair of the plurality of pairs of first and second signal contacts to a corresponding pair of the plurality of pairs of first and second center conductors at a first end of the cable; and connecting the shield to the ground plane at the first end of the cable, wherein the second row of ground contacts is located on a same side of the contact ribbon as the plurality of pairs of first and second signal contacts.

10. The method of manufacturing a cable assembly according to claim 9, wherein each pair of the plurality of pairs of first and second signal contacts is connected to the corresponding pair of the plurality of pairs of first and second center conductors by crimping or soldering.

11. The method of manufacturing a cable assembly according to claim 9, wherein the shield is connected to the ground plane by soldering.

12. The method of manufacturing a cable assembly according to claim 9, further comprising forming a housing for the contact ribbon before a support member connecting the plurality of pairs of first and second signal contacts is removed.

13. The method of manufacturing a cable assembly according to claim 12, wherein:

the housing includes at least one hole; and the support member is removed by punching or cutting the support member through the at least one hole of the housing.

14. The method of manufacturing a cable assembly according to claim 9, further comprising attaching the cable assembly to a substrate before a support member connecting the plurality of pairs of first and second signal contacts is removed.

15. The method of manufacturing a cable assembly according to claim 14, wherein each signal contact of the plurality of pairs of first and second signal contacts is connected to a corresponding hole in the substrate by soldering.

16. The method of manufacturing a cable assembly according to claim 9, wherein the plurality of pairs of first and second signal contacts are press-fit contacts or solderable contacts.

17. The method of manufacturing a cable assembly according to claim 9, wherein the plurality of pairs of first and second signal contacts are arranged in a single row.

18. The method of manufacturing a cable assembly according to claim 17, wherein a first distance between the first row of ground contacts and the second row of ground contacts is greater than a second distance between the single row of the plurality of pairs of first and second signal contacts and either of the first row of ground contacts or the second row of ground contacts.

19. The method of manufacturing a cable assembly according to claim 9, wherein the first row of ground contacts and the second row of ground contacts are located on a same side of the plurality of pairs of first and second signal contacts.

20. The method of manufacturing a cable assembly according to claim 9, wherein the first row of ground contacts and the second row of ground contacts are press-fit contacts or solderable contacts.

* * * * *